US009968171B2

(12) United States Patent
Park

(10) Patent No.: US 9,968,171 B2
(45) Date of Patent: May 15, 2018

(54) MULTIFUNCTIONAL HAIR TREATMENT DEVICE

(71) Applicant: ARAM HUVIS CO., LTD., Seongnam-si, Gyeonggi-do (KR)

(72) Inventor: Dong Soon Park, Mungyeong-si (KR)

(73) Assignee: ARAM HUVIS CO., LTD., Seongam-si, Gyeonggi-Do (KR)

( * ) Notice: Subject to any disclaimer, the term of this patent is extended or adjusted under 35 U.S.C. 154(b) by 177 days.

(21) Appl. No.: 14/906,219

(22) PCT Filed: Aug. 8, 2014

(86) PCT No.: PCT/KR2014/007385
§ 371 (c)(1),
(2) Date: Jan. 19, 2016

(87) PCT Pub. No.: WO2015/020480
PCT Pub. Date: Feb. 12, 2015

(65) Prior Publication Data

US 2016/0166034 A1 Jun. 16, 2016

(30) Foreign Application Priority Data

Aug. 8, 2013 (KR) ..... 10-2013-0094111

(51) Int. Cl.
*A45D 20/08* (2006.01)
*A45D 20/10* (2006.01)
*A45D 20/00* (2006.01)
*A45D 20/52* (2006.01)

(52) U.S. Cl.
CPC ..... *A45D 20/08* (2013.01); *A45D 20/00* (2013.01); *A45D 20/10* (2013.01); *A45D 20/52* (2013.01)

(58) Field of Classification Search
CPC ..... A45D 20/08; A45D 20/52; A45D 20/00; A45D 20/10
See application file for complete search history.

(56) References Cited

U.S. PATENT DOCUMENTS

| | | | | | |
|---|---|---|---|---|---|
| 4,620,374 | A * | 11/1986 | Patterson | A45D 20/00 | 132/212 |
| 5,526,578 | A * | 6/1996 | Iyer | A45D 20/10 | 239/443 |
| 5,944,031 | A * | 8/1999 | Farley | A45D 20/00 | 132/120 |
| 2007/0169369 | A1* | 7/2007 | Lok | A45D 20/12 | 34/97 |
| 2015/0035743 | A1* | 2/2015 | Rosener | G06F 3/014 | 345/156 |

FOREIGN PATENT DOCUMENTS

| | | | | |
|---|---|---|---|---|
| EP | 2186431 | A1 | 5/2010 | |
| JP | 2003-047520 | A | 2/2003 | |
| KR | 10-1075487 | B1 | 10/2011 | |
| WO | 2008-014577 | A1 | 2/2008 | |
| WO | WO 2010035096 | A2 * | 4/2010 | A45D 1/00 |

* cited by examiner

*Primary Examiner* — Jessica Yuen
(74) *Attorney, Agent, or Firm* — John K. Park; Park Law Firm

(57) ABSTRACT

A multifunctional hair treatment device. A handpiece in the shape of a glove has nozzles on fingers thereof. A device body draws in and heats ambient air, thereby creating hot wind. A blower tube connects the nozzles of the handpiece to the device body to supply hot wind created in the device body to the nozzles of the handpiece. A user can dry and style hair using the handpiece worn on his or her hand.

7 Claims, 3 Drawing Sheets

[Fig. 1]
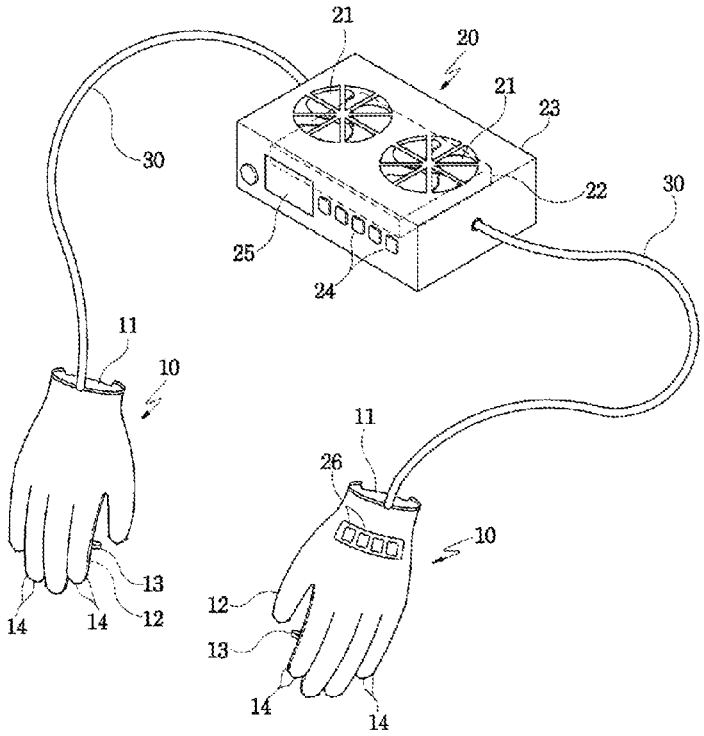
[Fig. 2]
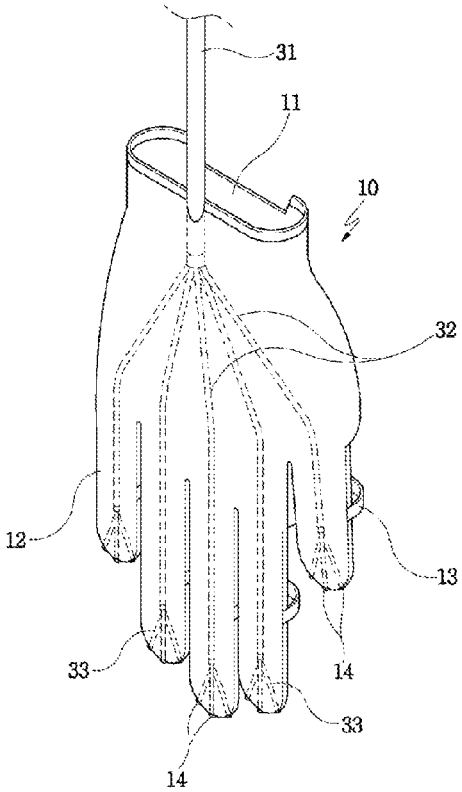

[Fig. 3]
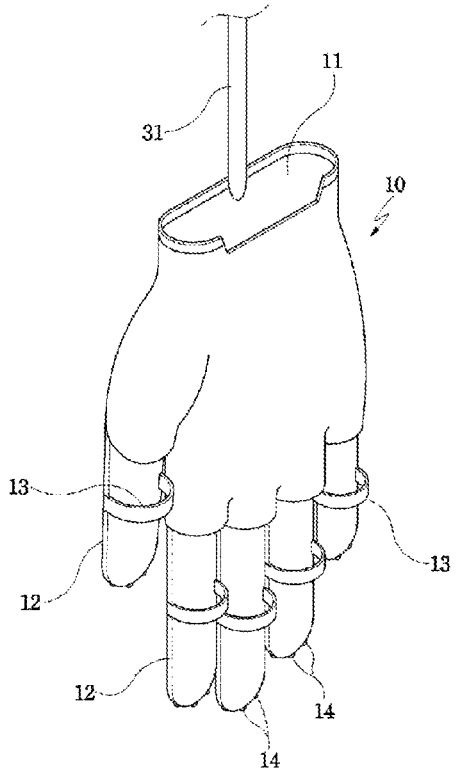
[Fig. 4]
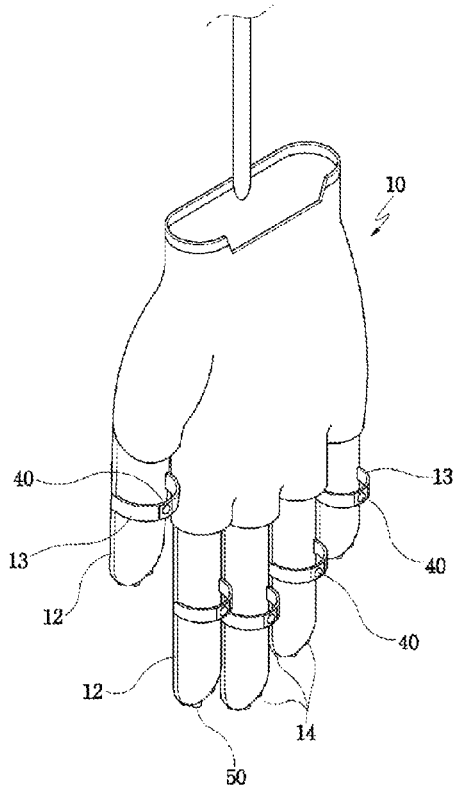

[Fig. 5]
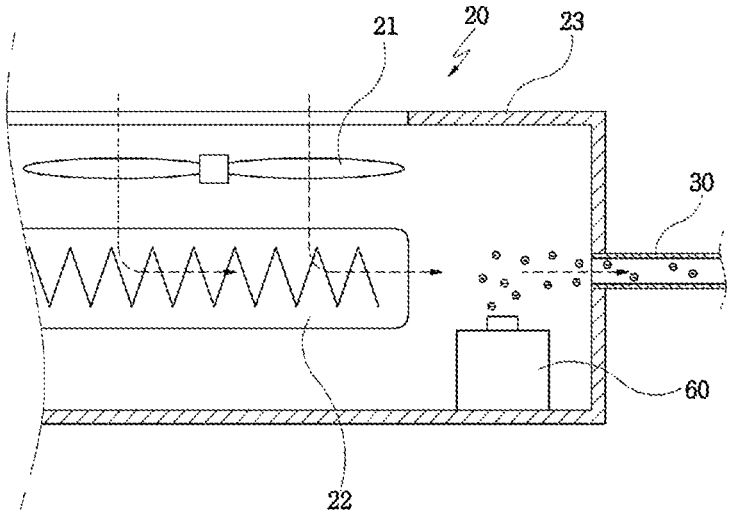

MULTIFUNCTIONAL HAIR TREATMENT DEVICE

TECHNICAL FIELD

The present invention generally relates to a multifunctional hair treatment device. More particularly, the present invention relates to a multifunctional hair treatment device able to assist in caring for hair and the scalp. The multifunctional hair treatment device includes: a pair of handpieces in the shape of gloves, the pair of handpieces having a plurality of nozzles on fingers thereof; and a device body connected to the pair of handpieces through blower tubes, the device body drawing and heating ambient air and supplying heated air to the pair of handpieces. When a user dries hair and the scalp, the user puts on the pair of handpieces on both hands, and discharges hot wind to every location of the hair and the scalp through the plurality of nozzles disposed on the handpiece fingers while massaging the hair and the scalp with his or her fingers, whereby the hair and the scalp can be rapidly dried. The user can adjust the temperature and the amount of hot wind discharged under the control of the controller disposed on the device body such that the temperature and amount of hot wind are suitable to the conditions of the hair and the scalp. The user can easily produce a desirable hair style by drying the hair with his or her fingers while drying the hair. It is possible to irradiate FIR (Far infrared) radiation onto the hair and the scalp of the user or supply negative ions to the hair and the scalp as required. At the same time, it is possible to measure the degree of humidity of the hair and the scalp.

BACKGROUND ART

In general, a hair drier is used to dry wet hair or the scalp or for the purpose of hair styling.

The hair drier has a coil heater and a blower fan in the interior thereof. In hot wind mode, the hair driver discharges hot wind by heating wind produced by the blower fan using the coil heater. In cold wind mode, the hair drier discharges wind produced by the blower fan without operating the coil heater. In stop mode, the power is turned off to stop the discharge of hot wind or cold wind.

As described above, the hair drier operates in distinct steps, such as the hot wind mode, the cold wind mode, and the stop mode, and a user cannot adjust the temperature and intensity of wind as desired. Since the hair is dried regardless of the conditions of the scalp and hair, it is difficult to precisely dry the hair.

In addition, a user must discharge wind to several locations of the hair by holding the hair drier while drying the air using the hair drier. Thus, it is difficult to dry every location of the hair and the scalp. When hot wind is used in order to rapidly dry the hair, it is difficult to detect the accurate temperature of hot wind discharged from the hair drier. When hot wind is used for a long time or the drier is maintained close to the hair due to a careless use, the hair or the scalp may be damaged.

Furthermore, even in the case in which cold wind is used, when the hair and the scalp are excessively dried, the hair or the scalp may be damaged.

In order to produce a hair style using the above-described hair drier, the user attempts to produce a hair style by blowing hot wind to a portion of hair by holding the hair drier in one hand while combing the portion of hair into an intended shape using a comb in the other hand. However, when the entire hair is to be styled, the operation of styling the hair must be performed while changing the positions of the hair drier and the comb in both hands. This operation is not easy to perform unless the user is highly experienced. It is therefore difficult to produce a desirable hair style, which is problematic.

DISCLOSURE

Technical Problem

Accordingly, the present invention has been made keeping in mind the above problems occurring in the related art, and the present invention is intended to propose a multifunctional hair treatment device able to assist in caring for hair and the scalp. The multifunctional hair treatment device includes: a pair of handpieces in the shape of gloves, the pair of handpieces having a plurality of nozzles on fingers thereof; and a device body connected to the pair of handpieces through blower tubes, the device body drawing and heating ambient air and supplying heated air to the pair of handpieces. When a user dries hair and the scalp, the user puts on the pair of handpieces on both hands, and discharges hot wind to every location of the hair and the scalp through the plurality of nozzles disposed on the handpiece fingers while massaging the hair and the scalp with his or her fingers, whereby the hair and the scalp can be rapidly dried. The user can adjust the temperature and the amount of hot wind discharged under the control of the controller disposed on the device body such that the temperature and amount of hot wind are suitable to the conditions of the hair and the scalp. The user can easily produce a desirable hair style by drying the hair with his or her fingers while drying the hair. It is possible to irradiate FIR radiation onto the hair and the scalp of the user or supply negative ions to the hair and the scalp of the user as required. At the same time, it is possible to measure the degree of humidity of the hair and the scalp.

Technical Solution

In order to achieve the above object, according to one aspect of the present invention, there is provided a multifunctional hair treatment device including: a handpiece in a shape of a glove, the handpiece having nozzles on fingers thereof; a device body drawing in and heating ambient air, thereby creating hot wind; and a blower tube connecting the nozzles of the handpiece to the device body to supply hot wind created in the device body to the nozzles of the handpiece, whereby a user can dry and style hair using the handpiece worn on his or her hand.

Advantageous Effects

As set forth above, when a user dries hair and the scalp using the multifunctional hair treatment device according to the present invention, the user puts on the pair of handpieces on both hands, and discharges hot wind to every location of the hair and the scalp through the plurality of nozzles disposed on the handpiece fingers while massaging the hair and the scalp with the fingers. Consequently, the hair and the scalp can be rapidly and easily dried using hot wind having a relatively low temperature. It is also possible to easily produce a variety of hair styles by touching the hair while drying the hair.

In addition, when the pair of handpieces are worn on the hands, the fingers of the user are exposed. It is thereby possible to stimulate the scalp by easily massaging the scalp using the fingers while drying the hair and the scalp.

Furthermore, it is possible to adjust the temperature and the amount of hot wind discharged through the nozzles of the handpiece using the controller disposed on the device body. It is thereby possible to adjust the temperature and the amount of hot wind discharged depending on the conditions of the hair and the scalp, thereby efficiently drying the hair.

In addition, the multifunctional hair treatment device according to the present invention includes the FIR lamps, the ion generator, and the moisture meters. It is possible to irradiate FIR radiation onto the hair and the scalp or supply negative ions to the hair and the scalp, thereby achieving advantageous effects for the hair and the scalp. It is also possible to measure the degree of humidity of the hair and the scalp using the moisture meter at any time, thereby preventing the hair and the scalp from being excessively dried and thus being damaged.

DESCRIPTION OF DRAWINGS

FIG. 1 is a view illustrating a multifunctional hair treatment device according to an embodiment of the present invention;

FIGS. 2 and 3 are perspective views illustrating the structure of a handpiece according to an embodiment of the present invention;

FIG. 4 is a view illustrating a structure according to an embodiment of the present invention in which an FIR lamp and a moisture meter are additionally disposed on the handpiece; and FIG. 5 is a view illustrating a structure according to an embodiment of the present invention in which an ion generator is additionally disposed within a body of the device.

BEST MODE

Hereinafter, embodiments of the present invention will be described in detail. However, the present invention should not be understood as limited to the embodiments set forth hereinafter unless departing from the scope of the present invention.

FIG. 1 is a view illustrating a multifunctional hair treatment device according to an embodiment of the present invention, and FIGS. 2 and 3 are perspective views illustrating the structure of a handpiece according to the embodiment of the present invention.

As illustrated in FIGS. 1 to 3, the multifunctional hair treatment device according to the embodiment of the present invention includes a pair of handpieces 10, a device body 20, and blower tubes 30. The pair of handpieces 10 is in the shape of gloves, and each of the handpieces 10 has nozzles 14 on the fingers thereof. The device body 20 draws and heats ambient air, thereby creating hot wind. Each of the blower tubes 30 connects the nozzles 14 of the corresponding handpiece 10 to the device body 20 to supply hot wind created in the device body 20 to the nozzles 14 of the handpiece 10.

When a user dries hair and the scalp using the multifunctional hair treatment device configured as above, the user puts on the pair of handpieces on both hands and massages the hair and the scalp with fingers while hot wind is being blown to every location of the hair and the scalp through the plurality of nozzles provided on the fingers of the handpieces. Thus, the user can rapidly dry the hair and the scalp. In addition, since the user can dry the hair while touching the hair with the fingers, the user can easily produce a desirable hair style.

Hereinafter, the configuration of the multifunctional hair treatment device according to the embodiment of the present invention will be described in detail. Each of the handpieces 10 is in the shape of gloves, and has an opening 11 in one side, through which a hand of the user is inserted, such that the handpieces 10 can be worn on both hands of the user. Each of the handpieces 10 is configured to surround the back of the hand, the palm of the hand, and the top portions of the fingers, except for the bottom portions of the fingers.

As illustrated in FIGS. 2 and 3, handpiece fingers 12 disposed on the glove-shaped handpieces 10 are configured to cover the top portions of the fingers of the user, whereas the bottom portions of the handpiece fingers 12 are open. When the user puts on the handpieces 10 configured as above, the bottom portions of the fingers of the user are exposed from the handpieces 10.

The handpieces 10 are configured such that the bottom portions of the fingers of the user are exposed such that the user can massage the scalp using the bare fingers while drying the hair and the scalp using the nozzles 14, which will be described hereinafter. In this manner, the user can sense the conditions of the hair and the scalp while stimulating the scalp by massaging the same.

Since the handpieces 10 are configured such that the handpiece fingers 12 cover only the top portions of the fingers of the user, the handpiece fingers 12 have fixing bands 13, with which the handpiece fingers 12 can be fixed to the fingers of the user.

That is, the fixing bands 13 are formed of an elastic material, with both ends thereof being fixed to both sides of the handpiece fingers 12. When the user puts on the handpieces 10, the user can easily fix the handpiece fingers 12 to his or her fingers by fitting his or her fingers into the fixing bands 13.

Although the present embodiment has been described of the configuration in which the fixing bands 13 are provided on the handpiece fingers 12, a variety of other types of strings, Velcro tapes, or the like in addition to the fixing bands 13 may be used.

The handpieces 10 as described above may be formed of elastic cloth or a synthetic resin. It is preferable that the handpieces 10 be formed of a heat-resistant material, the shape of which is not deformed by hot wind created from the device body 20, which will be described hereinafter.

In addition, each of the handpiece fingers 12 formed on the handpieces 10 is provided with the nozzles 14 from which wind is discharged in order to dry the hair and the scalp.

That is, one or more nozzles 14 are provided on each of the handpiece fingers 12, such that hot wind created from the device body 20, which will be described hereinafter, is supplied to the nozzles 14 via the corresponding blower tube 30 and then is discharged externally from the nozzles 14.

Here, since the bottom portions of the handpiece fingers 12 are opened as illustrated in FIG. 3, it is preferable that the nozzles 14 be provided on the distal ends of the handpiece fingers 12. When the user dries the hair by putting on the handpieces 10, the user can easily discharge wind toward the hair and the scalp while changing the direction in which wind is discharged from the nozzles 14 provided on the handpiece fingers 12.

According to the present embodiment, three nozzles 14 are provided on the distal end of each of the handpiece fingers 12 of the handpieces 10. When the user dries hair using the nozzles 14 of the handpiece fingers 12, the user can discharge a large quantity of hot wind toward the hair at a variety of angles.

As illustrated in FIGS. 2 and 3, the three nozzles 14 provided on the distal end of each of the handpiece fingers 12 are disposed on the tip and both sides of the tip such that hot wind can be discharged at a variety of angles through the nozzles 14. Thus, the user can efficiently dry every location of the hair while touching the hair using the handpiece fingers 12.

The above-described nozzles may be disposed at a variety of positions, in which hot wind can be discharged from the handpieces to hair, according to the structure of the handpieces, in addition to the distal ends of the handpiece fingers. The number of the nozzles may be adjusted depending on the structure of the handpieces.

The device body 20 serves to create wind by drawing ambient air and to supply hot wind to the blower tubes 30 connected to the pair of handpieces 10 by heating wind created thereby.

The device body 20 includes a blower fan 21, a heater 22, and a blower case 23. The blower fan 21 creates wind by drawing ambient air. The heater 22 is disposed inward of the blower fan 21 to create hot wind by heating air drawn in by the blower fan 21. The blower case 23 accommodates the blower fan 21 and the heater 22 therein, is connected to the blower tubes 30 connected to the handpieces 10, and guides hot wind created by the blower fan 21 and the heater 22 to the blower tubes 30.

According to this configuration, when the blower fan 21 creates wind by drawing ambient air into the blower case 23, air drawn into the blower case 23 is heated by the heater 22 disposed inward of the blower fan 21, thereby being converted to hot wind. Hot wind is then supplied to the blower tubes 30 connected to the blower case 23.

In addition, the device body 20 has a controller (not shown) that controls the supply of power while adjusting the temperature of hot wind created by the blower fan 21 and the heater 22, and the amount of hot wind discharged.

The controller (not shown) includes a control module (not shown) and control buttons 24. The control module (not shown) controls the supply of power to the device body 20, and controls the number of revolutions of the blower fan 21 and the temperature of heat generated by the heater 22. The control buttons 24 turn on or off the power of the device body 20 by inputting control signals to the control module (not shown), and are used to set the temperature of hot wind and the amount of hot wind discharged.

In addition, the controller (not shown) may have a display part 25 that displays the operating states of the device body 20, the temperature of hot wind, and the amount of hot wind discharged.

According to the present embodiment, as illustrated in FIG. 1, when the user sets the temperature of hot wind by manipulating the control buttons 24 disposed on the device body 20, a control signal is input into the control module (not shown), such that the heating temperature of the heater 22 is controlled according to the temperature set using the control buttons 24. Thus, hot wind having the temperature set by the user is supplied from the device body 20 to the blower tubes 30. Hot wind is then discharged through the nozzles 14 of the handpieces 10. When the user sets a large amount of hot wind discharged by manipulating the control buttons 24, the number of revolutions of the blower fan 21 is increased under the control of the control module (not shown), such that the amount of hot wind discharged through the nozzles 14 of the handpieces 10 is increased. In addition, the display part 25 displays the operating states of the device and the temperature and the discharged amount of hot wind, set by the control buttons 24, such that the user can check the operating state, the temperature of hot wind, and the discharged amount of hot wind.

In the detailed description, the control buttons 24 of the controller are disposed on the front surface of the device body 20. However, the present invention is not limited to this structure. Auxiliary control buttons 24 having the same functions as the above-described functions of the control buttons 24 may be additionally disposed on one of the pair of handpieces 10 for the sake of user comfort.

Here, the auxiliary control buttons 26 are connected to the control module (not shown) of the controller disposed in the device body 20, such that the auxiliary control buttons 26 can input control signals to the control module (not shown).

Each of the blower tubes 30 connects the nozzles 14 disposed on the corresponding handpiece 10 to the blower case 23 of the device body 20, whereby hot wind introduced from the device body 20 flows to the nozzles 14 of the handpiece 10.

In each of the blower tubes 30, one end portion thereof is connected to the blower case 23 of the device body 20, and the other end portion thereof is connected to the corresponding handpiece 10. The other end portion of the blower tube 30 extends through the handpiece 10 and the top portions of the handpiece fingers 12, and is divided into branches as many as the number of nozzles 14 disposed on the handpiece fingers 12, such that the branches thereof are respectively connected to the nozzles 14 of the handpiece fingers 12.

As illustrated in FIG. 2, the blower tube 30 according to the present embodiment includes a main blower tube 31, first auxiliary blower tubes 32, and second auxiliary blower tubes 33. One end of the main blower tube 31 is connected to the device body 20, and the other end of the main blower tube 31 is connected to the corresponding handpiece 10. The first auxiliary blower tubes 32 are five branches divided from the other end of the main blower tube 31, and respectively extend through the handpiece fingers 12. The second auxiliary blower tubes 33 are divided from the distal ends of the first auxiliary blower tubes 32, such that the second auxiliary blower tubes 33 are connected to the nozzles 14 in which three nozzles among the nozzles 14 are disposed on the distal end of each of the handpiece fingers 12.

With this configuration, when the device body 20 is operated, hot wind created by the device body 20 flows through the main blower tube 31 to enter the first auxiliary blower tubes 32 disposed in the handpiece fingers 12 of the handpieces 10. Hot wind that has entered the first auxiliary blower tubes 32 then flows through the second auxiliary blower tubes 33 divided from the distal ends of the first auxiliary blower tubes 32 before being discharged externally through the nozzles 14 disposed in the ends of the handpiece fingers 12.

The multifunctional hair treatment device according to the present invention as described above is configured such that the user can discharge hot wind to every location of the hair and the scalp through the plurality of nozzles 14 disposed on the handpiece fingers 12 by putting on the handpieces 10 on both hands, whereby the hair and the scalp can be rapidly and easily dried using hot wind having a relatively low temperature. It is possible to easily produce a variety of hair styles by touching the hair while drying the hair. In addition, it is possible to stimulate the scalp by pressing the scalp with the bottom portions of the fingers exposed from the handpieces 10 while drying the scalp.

In addition, it is possible to adjust the temperature and the amount of hot wind discharged through the nozzles 14 of the handpieces 10 depending on the conditions of the hair and the scalp, under the control of the controller (not shown), whereby the hair can be efficiently dried without causing damage to the hair or the scalp.

The multifunctional hair treatment device according to the present invention may further include a far infrared (FIR) lamp irradiating FIR radiation onto the hair and the scalp, a negative ion generator, a moisture meter able to measuring the degree of humidity in the hair and the scalp, and the like.

FIG. 4 is a view illustrating a structure according to an embodiment of the present invention in which an FIR lamp and a moisture meter are additionally disposed on the handpiece, and FIG. 5 is a view illustrating a structure according to an embodiment of the present invention in which an ion generator is additionally disposed within a body of the device.

As illustrated in FIG. 4, FIR lamps 40 are disposed on the fixing bands 13 disposed on the handpiece fingers 12 of the handpiece 10. The user having put on the handpieces 10 can irradiate FIR radiation onto the hair and the scalp while drying the hair using the nozzles 14 or massaging the hair or the scalp using the portions of the fingers exposed from the handpieces 10.

Here, the FIR lamps 40 may be constructed of, for example, an LED chip generating FIR radiation in a simple manner. Since the FIR lamps constructed in this manner are known in the art, detailed descriptions thereof will be omitted.

Since the multifunctional hair treatment device according to the present invention is configured to irradiate FIR radiation onto the hair and the scalp using the FIR lamps, it is possible to promote blood circulation in the scalp and sterilize a variety of bacteria, thereby preventing or reducing depilation. At the same time, it is possible to protect the scalp and the damaged hair and improve the texture of the hair.

Here, the FIR lamps 40 may not be disposed integrally with the handpieces 10. Instead, separate bands, which are detachably attachable to fingers, and to which FIR lamps are attached, may be provided. It is possible to use the FIR lamp-attached bands by selectively attaching the FIR lamp-attached bands to fingers.

In addition, as illustrated in FIG. 4, the moisture meter 50 may be disposed on one of the handpiece fingers 12 of the handpiece 10 in order to measure the degrees of humidity of the hair and the scalp while drying the hair. Since the moisture meter 50 is known in the art, detailed descriptions thereof will be omitted.

The use of the moisture meter 50 in this manner allows for measuring the humidity of the hair and the scalp at any time. It is therefore possible to maintain the degrees of humidity of the hair and the scalp in a suitable range, and to prevent the hair and the scalp from being excessively dried and thus being damaged.

In addition, as illustrated in FIG. 5, the ion generator 60 is disposed within the blower case 23 of the device body 20, on the portion to which the blower tube 30 is connected. Thus, ions generated by the ion generator 60 can be carried, on hot wind created by the blower fan 21 and the heater 22, into the blower tube 30. It is therefore possible to supply negative ions through the nozzles 14 (see FIG. 1) of the handpiece 10 (see FIG. 1).

Accordingly, hot wind containing negative ions is discharged onto the hair and the scalp while the hair is being dried, thereby enabling advantageous effects of preventing the hair and the scalp from being damaged, increasing the gloss of the hair, and stimulating scalp cells.

The FIR lamps 40, the moisture meter 50, and the negative ion generator 60 as described above are connected to and are controlled by the above-described controller (not shown) via wires and/or signal transmission lines. The user can conveniently operate the FIR lamps 40, the moisture meter 50, and the negative ion generator 60 using the control buttons 24 (see FIG. 1) disposed on the device body 20 or the auxiliary control buttons 26 (see FIG. 1) disposed on the handpiece 10 (see FIG. 1).

Hereinafter, the state of use of the multifunctional hair treatment device according to the present invention as configured above will be described with reference to FIGS. 1 to 5.

In order to dry hair and the scalp using the multifunctional hair treatment device according to the present invention, the user puts on the pair of handpieces 10 on both hands, and operates the blower fan 21 and the heater 22 using the control buttons 24 disposed on the device body 20, such that hot wind entering the blower tubes 30 from the device body 20 is discharged through the plurality of nozzles 14 disposed on the handpiece fingers 12 of the handpiece fingers 10.

In this process, the user can adjust the temperature and the amount of hot wind discharged through the nozzles 14 by manipulating the control buttons 24, such that the temperature and amount of hot wind are suitable to the conditions of the hair and the scalp.

Upon having adjusting the temperature and the amount of hot wind discharged, the user can dry every location of the hair and the scalp using hot wind discharged from the plurality of nozzles 14 disposed on the handpiece fingers 12. The user can also produce a variety of hair styles by touching the hair while drying the hair.

As described above, the user can selectively operate the negative ion generator 60 by manipulating the control buttons 24 while drying the hair and the scalp. Negative ions generated by the negative ion generator 60 can be carried on hot wind that is to be discharged onto the hair and the scalp, thereby achieving advantageous effects.

Furthermore, it is possible to massage the scalp using the fingers exposed from the handpiece fingers 12, thereby stimulating the scalp. In this case, as illustrated in FIG. 4, it is possible to irradiate FIR radiation onto the hair and the scalp using the FIR lamp 40, thereby improving blood circulation in the scalp and improving the texture of the hair.

When the hair and the scalp has been dried to a predetermined degree, the humidity of the hair and the scalp can be measured using the moisture meter 50 disposed on one of the handpiece fingers 12. Consequently, the user can check the degree of dryness of the hair and the scalp, and based on the result of measurement, can continue or stop the operation of the drying the hair and the scalp.

As set forth above, when the user dries hair and the scalp using the multifunctional hair treatment device according to the present invention, the user puts on the pair of handpieces on both hands, and discharges hot wind to every location of the hair and the scalp through the plurality of nozzles disposed on the handpiece fingers while massaging the hair and the scalp with the fingers. Consequently, the hair and the scalp can be rapidly and easily dried using hot wind having a relatively low temperature. It is also possible to easily produce a variety of hair styles by touching the hair while drying the hair.

In addition, when the pair of handpieces is worn on the hands, the fingers of the user are exposed. It is thereby possible to stimulate the scalp by easily massaging the scalp using the fingers while drying the hair and the scalp.

Furthermore, it is possible to adjust the temperature and the amount of hot wind discharged through the nozzles of the handpiece using the controller disposed on the device body. It is thereby possible to adjust the temperature and the amount of hot wind discharged depending on the conditions of the hair and the scalp, thereby efficiently drying the hair.

In addition, the multifunctional hair treatment device according to the present invention includes the FIR lamps, the ion generator, and the moisture meters. It is possible to irradiate FIR radiation onto the hair and the scalp or supply negative ions to the hair and the scalp, thereby achieving advantageous effects on the hair and the scalp. It is also possible to measure the degree of humidity of the hair and the scalp using the moisture meter at any time, thereby preventing the hair and the scalp from being excessively dried and thus being damaged.

INDUSTRIAL APPLICABILITY

When a user dries hair and the scalp using the multifunctional hair treatment device according to the present invention, the user puts on the pair of handpieces on both hands, and discharges hot wind to every location of the hair and the scalp through the plurality of nozzles disposed on the handpiece fingers while massaging the hair and the scalp with the fingers. It is therefore easy for the user to produce a desirable hair style. In addition, since the FIR lamps, the ion generator, and the moisture meters are provided, it is possible to systematically care for the hair and the scalp. Accordingly, the multifunctional hair treatment device can be used in a variety of hair care shops or at home.

The invention claimed is:

1. A multifunctional hair treatment device comprising:

a handpiece in a shape of a glove, the handpiece having nozzles on fingers thereof;

a device body drawing and heating ambient air, thereby creating hot wind; and a blower tube connecting the nozzles of the handpiece to the device body to supply hot wind created in the device body to the nozzles of the handpiece, whereby a user is able to dry and style hair using the handpiece worn on his or her hand, wherein the device body comprises:

a blower fan creating wind by drawing ambient air;

a heater disposed inward of the blower fan to create hot wind by heating the air drawn in by the blower fan;

a blower case accommodating the blower fan and the heater therein, the blower case being connected to the blower tube connected to the handpiece to guide the hot wind created by the blower 21 and the heater to the blower tube; and a controller controlling power while adjusting a temperature of the hot wind created by the blower fan and the heater, and an amount of the hot wind to be discharged, wherein the controller comprises:

a control module controlling the power of the device body, a number of revolutions of the blower fan, and a temperature of heat generated by the heater; and a control button turning on or off the power of the device body by inputting a control signal to the control module, the control button being used to set the temperature of the hot wind generated by the blower fan and the heater and the amount of the hot wind discharged, and wherein the handpiece comprises an auxiliary control button connected to the control module of the controller, the auxiliary control button being used to turn on or off power of the device body and to set the temperature of the hot wind generated by the blower fan and the heater and the amount of the hot wind discharged.

2. The multifunctional hair treatment device according to claim 1, wherein a pair of the handpieces is provided, allowing the user to wear the pair of the handpieces on both hands.

3. The multifunctional hair treatment device according to claim 1, wherein the controller comprises a display part displaying operating states of the multifunctional hair treatment device.

4. The multifunctional hair treatment device according to claim 1, wherein a negative ion generator is disposed within the device body.

5. The multifunctional hair treatment device according to claim 1, wherein a moisture meter is disposed on one of the handpiece fingers of the handpiece.

6. A multifunctional hair treatment device comprising:

a handpiece in a shape of a glove, the handpiece having nozzles on fingers thereof;

a device body drawing and heating ambient air, thereby creating hot wind; and a blower tube connecting the nozzles of the handpiece to the device body to supply hot wind created in the device body to the nozzles of the handpiece, whereby a user is able to dry and style hair using the handpiece worn on his or her hand, wherein the handpiece comprises handpiece fingers with bottom portions thereof being opened, such that fingers of the user are exposed when the user puts on the handpiece, wherein each of the handpiece fingers comprises a fixing band, with which each of the handpiece fingers is fixed to a corresponding finger of the user, and wherein a far infrared lamp is disposed on the fixing band.

7. A multifunctional hair treatment device comprising:

a handpiece in a shape of a glove, the handpiece having nozzles on fingers thereof;

a device body drawing and heating ambient air, thereby creating hot wind; and a blower tube connecting the nozzles of the handpiece to the device body to supply hot wind created in the device body to the nozzles of the handpiece, whereby a user is able to dry and style hair using the handpiece worn on his or her hand, wherein one or more of the nozzles are disposed on a tip of each of the fingers of the handpiece, and wherein one end of the blower tube is connected to the device body, and the other end of the blower tube is connected to the handpiece, the other end of the blower tube extending through the handpiece and the handpiece fingers of the handpiece, and being divided into branches in a number equal to a number of the nozzles disposed on the handpiece fingers, each of the branches being connected to a corresponding nozzle among the nozzles.

* * * * *